US006770859B2

(12) United States Patent
Kang

(10) Patent No.: US 6,770,859 B2
(45) Date of Patent: Aug. 3, 2004

(54) MICROWAVE OVEN

(75) Inventor: Jeon-Hong Kang, Suwon (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 10/160,012

(22) Filed: Jun. 4, 2002

(65) Prior Publication Data

US 2003/0102307 A1 Jun. 5, 2003

(30) Foreign Application Priority Data

Dec. 4, 2001 (KR) ..... 2001-76071

(51) Int. Cl.[7] ..... H05B 6/70
(52) U.S. Cl. ..... 219/746; 219/751; 219/754
(58) Field of Search ..... 219/746, 751, 219/754, 745–748, 749, 750, 763, 728, 708, 757, 681

(56) References Cited

U.S. PATENT DOCUMENTS 4,019,009 A * 4/1977 Kusunoki et al. ..... 219/746
4,249,058 A * 2/1981 Lentz et al. ..... 219/751
4,616,119 A 10/1986 Shin
5,877,479 A * 3/1999 Yu ..... 219/754
5,981,928 A 11/1999 Lee

FOREIGN PATENT DOCUMENTS

JP 03015190 A * 1/1991 ..... H05B/6/68

* cited by examiner

*Primary Examiner*—Quang T. Van
(74) *Attorney, Agent, or Firm*—Staas & Halsey LLP

(57) ABSTRACT

A microwave oven includes openings and microwave dispersing apparatuses which are arranged to align with a magnetron in a row below a cooking cavity so as to reduce the overall size of a waveguide and uniformly reflect high-frequency electromagnetic waves to all regions of the cooking cavity. The center of a first opening is disposed at a downstream location away from the magnetron by a distance corresponding to one of odd numbers times a half-wavelength of a standing wave in the waveguide, while the center of a second opening is disposed at an upstream location which is offset from another distance away from the magnetron corresponding to another one of the odd numbers times the half-wavelength of the standing wave in the waveguide.

23 Claims, 7 Drawing Sheets

MICROWAVE OVEN

CROSS-REFERENCE TO RELATED APPLICATIONS

This application claims the benefit of Korean Application No. 2001-76071, filed Dec. 4, 2001, in the Korean Industrial Property Office, the disclosure of which is incorporated herein by reference.

BACKGROUND OF THE INVENTION

1. Field of the Invention

The present invention relates to a microwave oven, and more particularly to a microwave oven comprising a plurality of microwave dispersing apparatuses which disperse high-frequency electromagnetic waves and are arranged in a row below a cooking cavity so as to uniformly radiate the high-frequency electromagnetic waves into the cooking cavity.

2. Description of the Related Art

In general, a microwave oven is an electrically operated oven which cooks food disposed in a cooking cavity using high-frequency electromagnetic waves generated from a magnetron installed in a machine room. Specifically, such a microwave oven radiates high-frequency electromagnetic waves into a cooking cavity to repeatedly excite the molecular bonds of moisture laden in food. This excitation generates an intermolecular frictional heat within the food to cook the food.

A cooking cavity of a microwave oven includes an opening which is provided at its front, an air inlet and outlet holes which are provided at its sidewalls, and a cooking tray which receives food to be cooked, and is disposed on a bottom of the cooking cavity. A machine room of the microwave oven includes electrical elements such as a magnetron, a high-voltage transformer, a high-voltage condenser which generates high-frequency electromagnetic waves, and a cooling fan which cools the above electrical elements. The cooking cavity is partitioned from the machine room by one of the sidewalls of the microwave oven.

A microwave oven can be classified into a turntable type microwave oven and a stirrer type microwave oven. A turntable type microwave oven rotates a cooking tray at a low speed to uniformly radiate food with high-frequency electromagnetic waves. A stirrer type microwave oven includes a microwave dispersing apparatus and a waveguide which is provided to one of an upper wall, a lower wall and sidewalls of the microwave oven. The waveguide allows a cooking cavity to communicate with a machine room as the waveguide is provided at a portion extended into the machine room having a magnetron and at a portion disposed in the cooking cavity having the microwave dispersing apparatus. The microwave dispersing apparatus disperses high-frequency electromagnetic waves guided by the waveguide to the cooking cavity so as to uniformly radiate the high-frequency electromagnetic waves to food.

The present invention relates to a stirrer type microwave oven. FIGS. 1 and 2 show a conventional stirrer type microwave oven having a waveguide 10 and microwave dispersing apparatuses 15 that are disposed below a cooking cavity 1. FIG. 2 is a cross-sectional view taken along line II—II of FIG. 1.

As shown in FIGS. 1 and 2, the conventional stirrer type microwave oven includes a cabinet (not shown) which defines an exterior of the microwave oven and in which the cooking cavity 1 and a machine room 2 are partitioned. The cooking cavity 1 is configured into a box shape having an opening which receives food to be cooked, and a cooking tray 3 which is provided at a bottom of the cooking cavity 1. To rotate the cooking tray 3 at a low speed, the cooking tray 3 is centrally connected at its lower surface to a motor 4. The cooking tray 3 cooperates with the microwave dispersing apparatuses 15 (described later) so as to more uniformly cook the food. Alternatively, the cooking tray 3 may be fixedly mounted on the bottom of the cooking cavity 1 without the motor 4 so as to cook the food placed on the cooking tray 3 with only the high-frequency electromagnetic waves that are uniformly generated from the microwave dispersing apparatuses 15.

The machine room 2 includes a magnetron 5, a high-tension transformer (not shown), a high voltage condenser (not shown) which applies a high voltage current to the magnetron 5, and a cooling fan (not shown) which cools the above electrical elements.

The waveguide 10 is disposed below the cooking cavity 1 and the machine room 2, and guides the high-frequency electromagnetic waves generated from the magnetron 5 to the cooking cavity 1. The waveguide 10 is configured to have an approximately hexahedral box shape having a large surface area, and partially extends to the machine room 2. The magnetron 5 is installed in a portion of the waveguide 10, which is extended to the machine room 2.

The waveguide 10 comprises openings 11 which are formed at approximately a middle portion of the cooking cavity 1 so as to be located at the same distance from the magnetron 5 and are positioned perpendicular to a front face of the cooking cavity 1. High-frequency electromagnetic waves generated from the magnetron 5 are guided by the waveguide 10 and radiated into the cooking cavity 1 through the openings 11.

The waveguide 10 further includes the microwave dispersing apparatuses 15 to disperse the high-frequency electromagnetic waves, which are guided by the waveguide 10 and introduced through the openings 11, into the cooking cavity 1. The microwave dispersing apparatuses 15 are positioned so as to align with the openings 11.

Each of the microwave dispersing apparatuses 15 comprises a motor 16 which is disposed below the waveguide 10, a dispersing fan 17 which is disposed above the opening 11 of the waveguide 10, and a driving shaft 18 connected between the motor 16 and the dispersing fan 17 which transmits a turning force from the motor 16 to the dispersing fan 17.

The high-frequency electromagnetic waves are first generated from the magnetron 5 and then guided by the waveguide 10. The high-frequency electromagnetic waves in the waveguide 10 pass through the openings 11, which are disposed at a middle portion of the cooking cavity 1 and spaced at a certain distance from each other. Subsequently, the high-frequency electromagnetic waves are reflected diffusely by a rotation of the dispersing fans 17 and dispersed into a region of the cooking cavity 1 as the cooking tray 3 is rotated at a low speed. The high-frequency electromagnetic waves are dispersed into an internal space of the cooking cavity 1 so as to evenly cook the food placed on the cooking tray 3.

However, since the above-mentioned conventional stirrer type microwave oven includes openings disposed at an approximately middle portion of a cooking cavity and spaced at the same distance from a magnetron, so as to equally distribute high-frequency electromagnetic waves to both of the openings, a waveguide must inevitability have a surface area occupying nearly a full surface area of the cooking cavity. Hence, the size and manufacturing cost of the conventional stirrer type microwave oven must be increased due to the structural provision of its waveguide. In addition, since the openings are positioned perpendicular to a front face of the cooking cavity, where the cooking cavity has a rectangular shape with a front width larger than a side width parallel to the openings, dispersion of the high-frequency electromagnetic waves toward both sides of the cooking cavity is not sufficiently achieved. Therefore, food in the cooking cavity of the conventional stirrer type microwave oven is unevenly cooked.

SUMMARY OF THE INVENTION

Accordingly, it is an object of the present invention is to provide a microwave oven having openings and microwave dispersing apparatuses which are provided at a bottom of a cooking cavity and are in alignment with a magnetron so as to reduce the size of a waveguide and evenly disperse high-frequency electromagnetic waves to all sides of the cooking cavity.

Additional objects and advantages of the invention will be set forth in part in the description which follows and, in part, will be obvious from the description, or may be learned by practice of the invention.

To achieve the above and other objects of the present invention, there is provided a microwave oven comprising a main body having a cooking cavity and a machine room which is partitioned from the cooking cavity, a waveguide which is disposed below the cooking cavity and the machine room, a magnetron which is housed in the machine room and coupled to the waveguide, openings which are formed at the waveguide and allow communication between the waveguide and the cooking cavity, and microwave dispersing apparatuses which are disposed at corresponding ones of the openings and disperse high-frequency electromagnetic waves, wherein the openings comprise a first opening which is located at the waveguide and a second opening which is located between the first opening and the magnetron.

According to an aspect of the present invention, the waveguide comprises a laterally elongated structure having a width smaller than the width of the cooking cavity. The center of the first opening is disposed at a first location away from the magnetron by a distance corresponding to one of odd numbers times a half-wavelength of a standing wave in the waveguide. The center of the second opening is disposed at a second location which is offset from another distance away from the magnetron corresponding to another one of the odd numbers times the half-wavelength of the standing wave in the waveguide.

According to another aspect of the present invention, both centers of the first and second openings are disposed at corresponding ones of locations away from the magnetron by distances corresponding to corresponding ones of odd numbers times the half-wavelength of the standing wave in the waveguide, wherein the size of the second opening is smaller than the first opening.

According to yet another aspect of the present invention, both centers of the first and second openings are disposed at corresponding ones of locations away from the magnetron by distances corresponding to corresponding ones of odd numbers times the half-wavelength of the standing wave in the waveguide, wherein the second opening comprises a plurality of slits which extend laterally along the length of the waveguide.

According to still another aspect of the present invention, the microwave oven may include a downward microwave dispersing apparatus which downwardly disperses the high-frequency electromagnetic waves reflected by the microwave dispersing apparatuses installed at the bottom of the cooking cavity, wherein the downward microwave dispersing apparatus is installed at an upper portion of the cooking cavity.

BRIEF DESCRIPTION OF THE DRAWINGS

The above and other objects, features and advantages of the present invention will become more apparent and more readily appreciated by describing in detail preferred embodiments thereof with references to the accompanying drawings, in which.

DETAILED DESCRIPTION OF THE PREFERRED EMBODIMENTS

Figure 1:
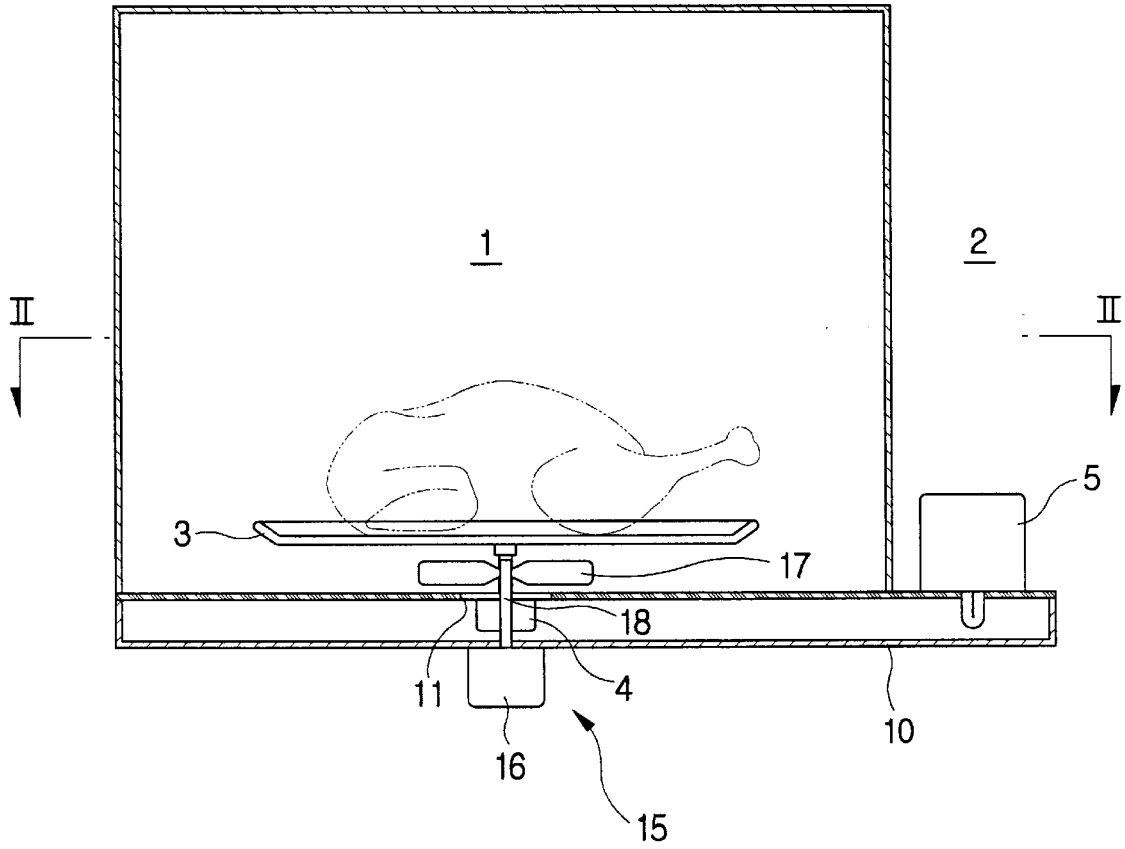
FIG. 1 (PRIOR ART)
FIG. 1 is a schematic side cross-sectional view showing a conventional stirrer type microwave oven having a waveguide.
Figure 2:
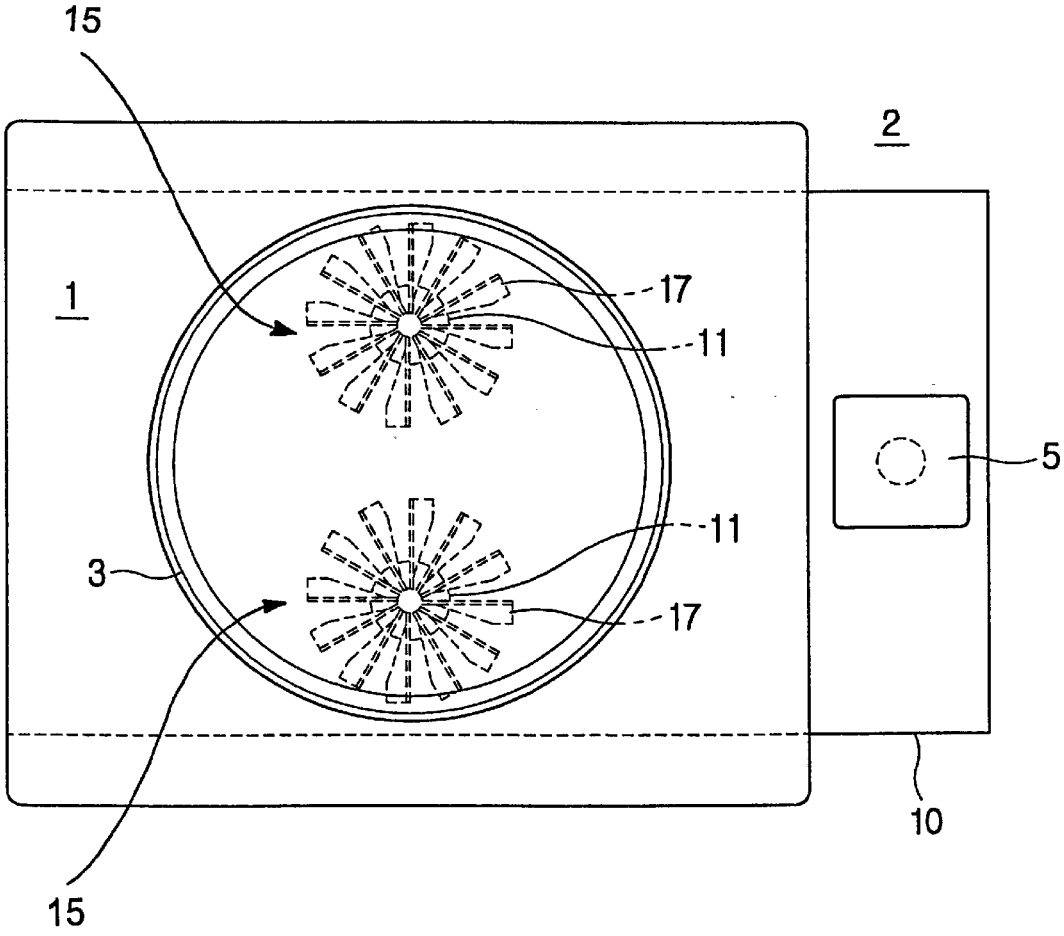
FIG. 2 (PRIOR ART)
FIG. 2 is a cross-sectional view taken along line II—II of FIG. 1.

Reference will now be made in detail to the present preferred embodiments of the present invention, examples of which are illustrated in the accompanying drawings, wherein like reference numerals refer to like elements throughout. The embodiments are described below in order to explain the present invention by referring to the figures.

Figure 3:
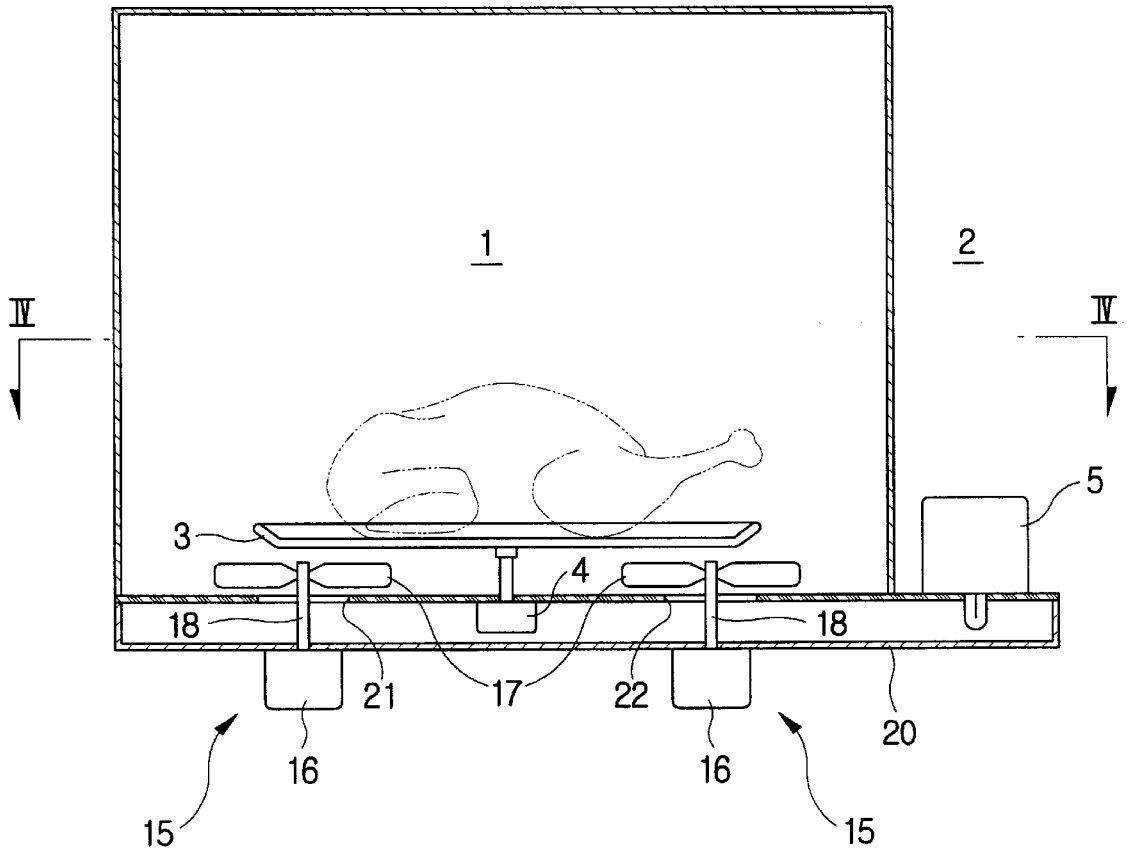
FIG. 3 is a schematic side cross-sectional view showing a microwave oven having a waveguide according to an embodiment of the present invention.
Figure 4:
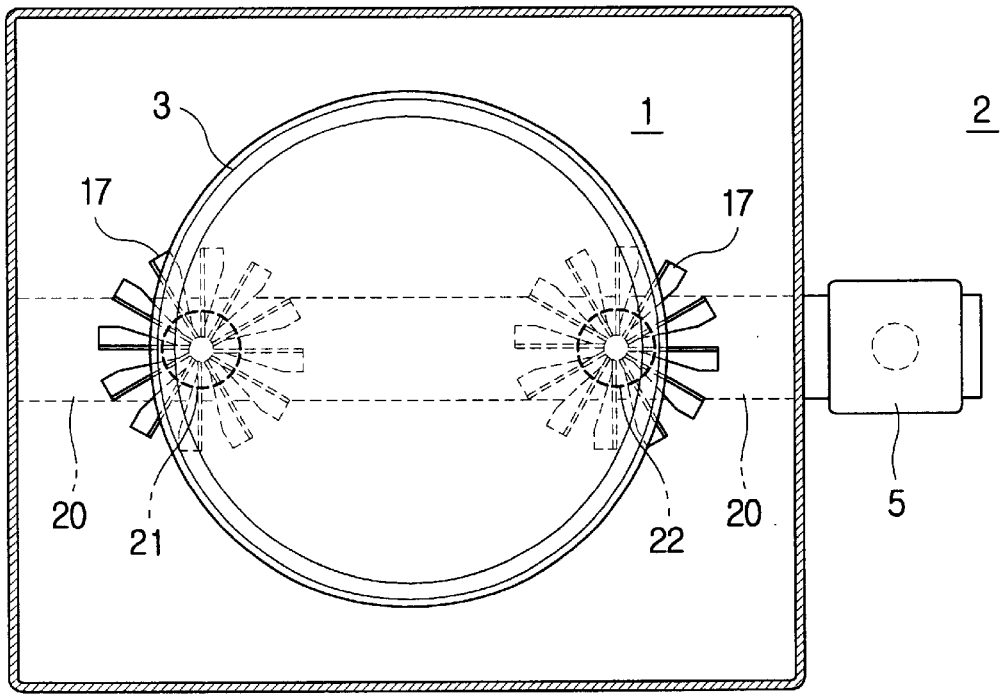
FIG. 4 is a cross-sectional view taken along line IV—IV of FIG. 3.

FIGS. 3 and 4 show a microwave oven having a waveguide according to an embodiment of the present invention. The microwave oven includes a cooking cavity 1, a cooking tray 3 which receives food to be cooked, and a machine room 2 having a magnetron 5 which generates high-frequency electromagnetic waves as a heating source to cook the food. The cooking tray 3 may be fixedly mounted on a bottom of the cooking cavity 1. Alternatively, the cooking tray 3 may be connected to a motor 4 installed below the cooking tray 3 so as to be rotated at a low speed during a cooking operation of the food.

A waveguide 20 is attached to the bottom of the cooking cavity 1, and partially extends to the machine room 2. The magnetron 5 is installed in a portion of the waveguide 20 which extends to the machine room 2 so as to have high-frequency electromagnetic waves generated from the magnetron 5 guided along the waveguide 20 to a space below the cooking cavity 1.

As shown in FIG. 4, the waveguide 20 comprises an elongated box structure which runs parallel along the length and below the center of the cooking cavity 1. The length of the elongated box structure is considerably greater than the width of the elongated box structure.

The waveguide 20 includes at its upper face first and second openings 21 and 22 through which the waveguide 20 communicates with the cooking cavity 1. The first opening 21 is positioned at a left side of the center of the cooking cavity 1, i.e., at a downstream portion of the waveguide 20 with respect to its center, and the second opening 22 is positioned at a right side of the center of the cooking cavity 1, i.e., at an upstream portion of the waveguide 20 with respect to its center. In addition, the first and second openings 21 and 22 are positioned so as to be aligned with the magnetron 5 in a row. Accordingly, part of the high-frequency electromagnetic waves are introduced into the cooking cavity 1 through the second opening 22, and the remaining high-frequency electromagnetic waves which have not passed through the second opening 22 are introduced into the cooking cavity 1 through the first opening 21.

According to an aspect of the present invention, each of the first and second openings 21 and 22 comprises a circular shape which allows easy passage of the high-frequency electromagnetic waves. However, the first and second openings 21 and 22 are not limited to the circular shape and may be configured to have other shapes.

According to another aspect of the present invention, the first and second openings 21 and 22 are disposed at corresponding ones of locations which allow the high-frequency electromagnetic waves of a specific frequency to evenly pass through the first and second openings 21 and 22.

That is, it is a known fact that high-frequency electromagnetic waves pass through openings more easily as the openings are located away from a magnetron by distances corresponding to an odd number times a half-wavelength of a standing wave generated within a waveguide (a half waveguide wavelength or a half-wavelength of a waveguide frequency). A wavelength of a microwave which passes through the waveguide is determined according to, for example, a length of the waveguide. Thus, the waveguide has its own waveguide frequency and wavelength relating to a wave being able to travel inside the waveguide. Therefore, a wavelength of frequencies greater than, for example, the wavelength of the waveguide frequency may not pass through the waveguide. The wavelength of the waveguide frequency (waveguide wavelength), in this case, is a cut off wavelength of the waveguide so as to allow the waveguide to guide microwaves having a predetermined frequency.

Accordingly, the location of the second opening 22 is offset from the location away from the magnetron 5 by a distance corresponding to one of odd numbers times the half-wavelength of the standing wave in the waveguide so as to not discharge all of the high-frequency electromagnetic waves generated from the magnetron 5. On the other hand, the location of the first opening 21 coincides with the location away from the magnetron 5 by a distance corresponding to one of the odd numbers times the half-wavelength of the standing wave in the waveguide so as to allow the remaining high-frequency electromagnetic waves which have not passed through the second opening 22 to discharge through the first opening 21.

That is, since the openings 21 and 22 are disposed in a row and aligned with the magnetron 5, approximately half of the high-frequency electromagnetic waves are first discharged through the second opening 22, and the remaining half of the high-frequency electromagnetic waves are discharged through the first opening 21 which is disposed in the downstream portion of the waveguide 20. Therefore, the high-frequency electromagnetic waves generated from the magnetron 5 can be equally introduced and dispersed into the cooking cavity 1 through both of the openings 21 and 22, thereby uniformly cooking the food contained in the cooking cavity 1.

The cooking tray 3 is positioned above the openings 21 and 22. However, since the cooking tray 3 is made of a material capable of transmitting the high-frequency electromagnetic waves, the food placed on the cooking tray 3 is not shielded by the cooking tray 3.

According to still another aspect of the present invention, the microwave oven further includes microwave dispersing apparatuses 15 which are provided at corresponding ones of the openings 21 and 22. The microwave dispersing apparatuses 15 disperse the high-frequency electromagnetic waves introduced into the cooking cavity 1 through the openings 21 and 22 by diffusely reflecting the high-frequency electromagnetic waves. Therefore, the microwave dispersing apparatuses 15 allow the high-frequency electromagnetic waves to evenly penetrate throughout the food placed on the cooking tray 3. Each of the microwave dispersing apparatuses 15 includes a motor 16 which is disposed below the waveguide 20, a dispersing fan 17 which is disposed above one of the openings 21 and 22, and a driving shaft 18 connected between the motor 16 and the dispersing fan 17 which transmits a turning force from the motor 16 to the dispersing fan 17.

According to yet another aspect of the present invention, the dispersing fans 17 may be designed so as to be disposed within the waveguide 20. In such a case, the size of the dispersing fans 17 can be further reduced so as to allow more compact microwave ovens to be produced.

According to the embodiment of FIGS. 3 and 4, the high-frequency electromagnetic waves generated from the magnetron 5 are guided by the waveguide 20. Approximately half of the high-frequency electromagnetic waves guided by the waveguide 20 are first introduced into the cooking cavity 1 through the second opening 22, which is disposed at a location of the waveguide 20 that is offset from the location away from the magnetron 5 by a distance corresponding to one of the odd numbers times a half-wavelength of the standing wave in the waveguide. The remaining half of the high-frequency electromagnetic waves are introduced into the cooking cavity 1 through the first opening 21, which is disposed at a location of the waveguide 20 which coincides with the location away from the magnetron 5 by a distance corresponding to one of the odd numbers times the half-wavelength of the standing wave in the waveguide.

During this dispersion of the high-frequency electromagnetic waves, the cooking tray 3, on which the food is placed, is rotated at a low speed, so as to evenly cook the food on the cooking tray 3 using the high-frequency electromagnetic waves diffusely reflected by walls defining the cooking cavity 1.

Figure 5:
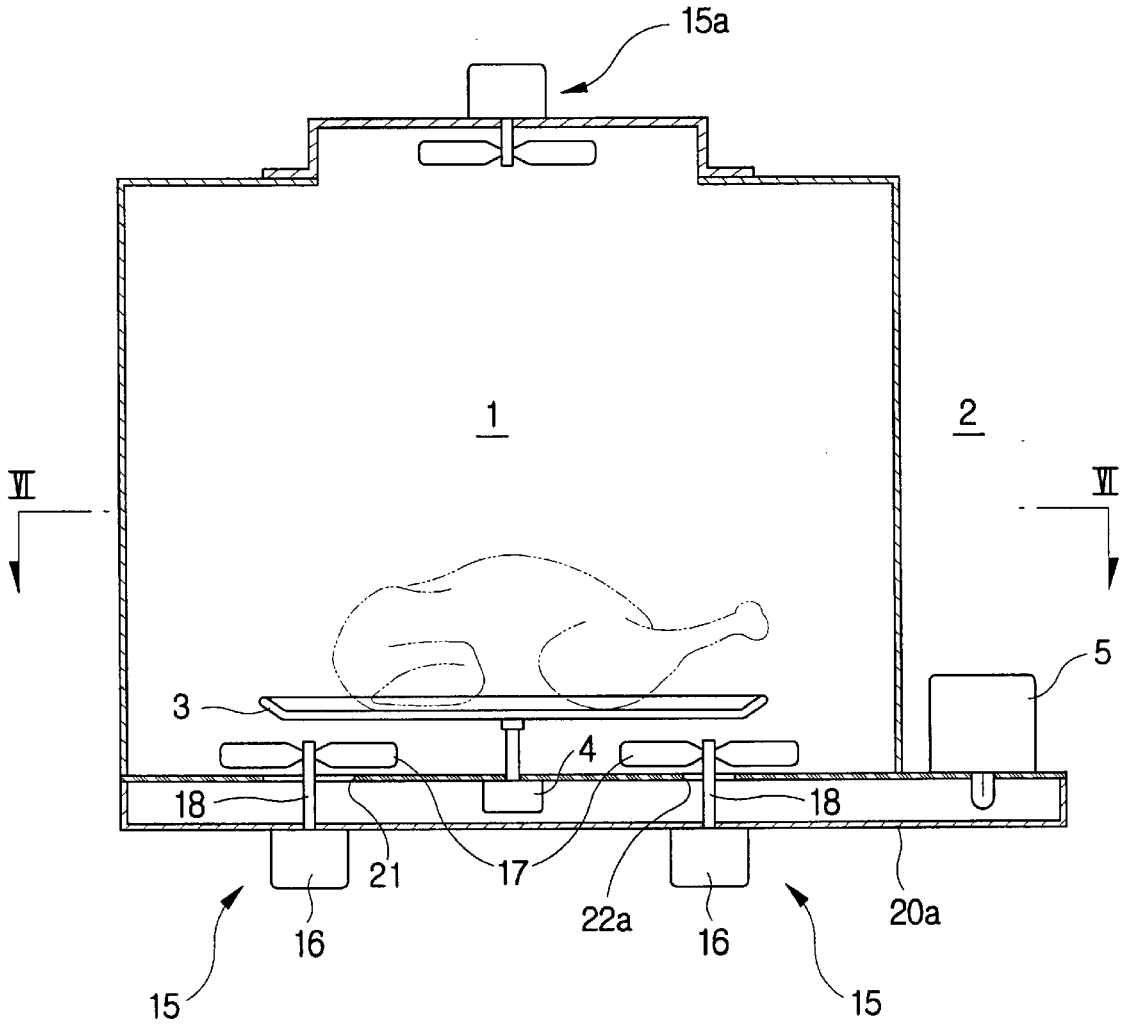
FIG. 5 is a schematic side cross-sectional view showing a microwave oven having a waveguide according to another embodiment of the present invention.
Figure 6:
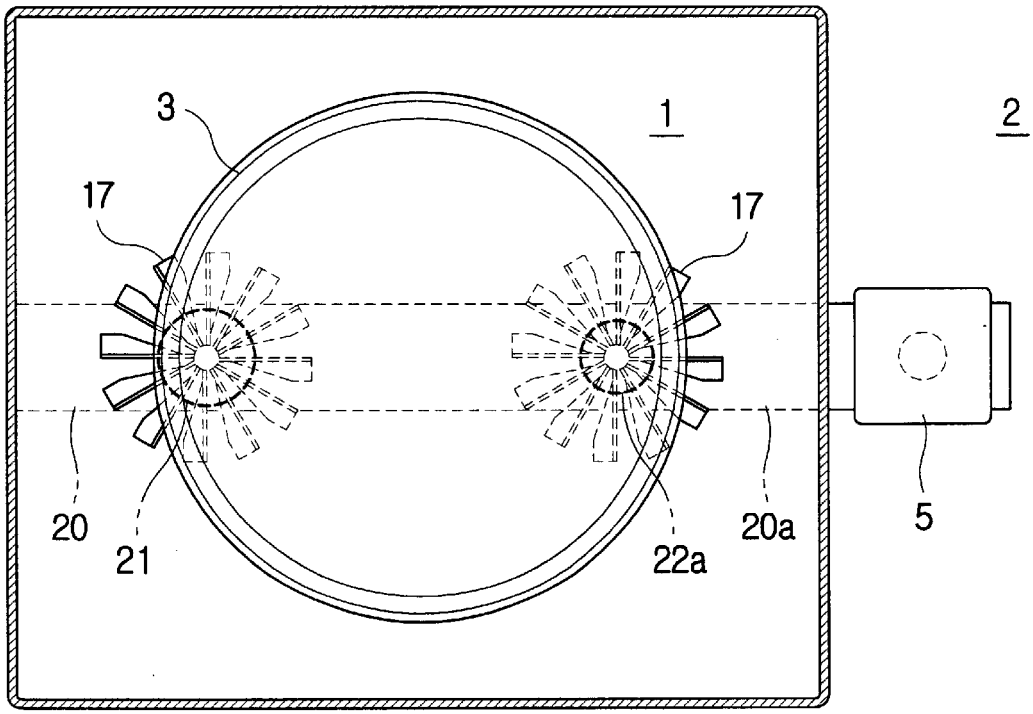
FIG. 6 is a cross-sectional view taken along line VI—VI of FIG. 5.

FIGS. 5 and 6 show a microwave oven according to another embodiment of the present invention. The microwave oven of FIGS. 5 and 6 is similar to the microwave according to FIGS. 3 and 4, in that first and second openings 21 and 22*a* align with a magnetron 5 in a row. In addition, the first and second openings 21 and 22*a* are provided with corresponding ones of microwave dispersing apparatuses 15. However, both of the first and second openings 21 and 22*a* are disposed at corresponding ones of locations of a waveguide 20*a*, which are away from the magnetron by a distance corresponding to one of odd numbers times a half-wavelength of the standing wave in the waveguide while the second opening 22*a* is sized to be smaller than the first opening 21.

Therefore, the high-frequency electromagnetic waves generated from the magnetron 5 are not completely discharged through the second opening 22*a* which is disposed at a upstream of the first opening 21. That is, although both of the first and second openings 21 and 22*a* are positioned to be away from the magnetron 5 by distances corresponding to corresponding ones of the odd numbers times the half-wavelength of the standing wave in the waveguide approximately half of the high-frequency electromagnetic waves are first discharged into a cooking cavity 1 because the second opening 22*a* is sized to be smaller than the first opening 21. The remaining half of the high-frequency electromagnetic waves are discharged into the cooking cavity 1 through the first opening 21. Accordingly, food placed on a cooking tray 3 can be evenly cooked by the high-frequency electromagnetic waves equally radiated from the first and second openings 21 and 22*a*.

According to still yet another aspect of the present invention, the microwave oven according to FIGS. 5 and 6 further includes a downward microwave dispersing apparatus 15*a* in addition to the microwave dispersing apparatuses 15 that are disposed at corresponding ones of the first and second openings 21 and 22*a*. The downward microwave dispersing apparatus 15*a* is positioned at an upper portion of the cooking cavity 1. The downward microwave dispersing apparatus 15*a* downwardly disperses the high-frequency electromagnetic waves dispersed by the microwave dispersing apparatuses 15 and allows more uniform radiation of the high-frequency electromagnetic waves to the food.

To avoid the repetition, the remaining components of the microwave oven of FIGS. 5 and 6 will not be described in detail because they are the same as shown in the microwave oven according to the embodiment shown in FIGS. 3 and 4.

It is understood that the downward dispersing apparatus 15*a* incorporated into the microwave oven of FIGS. 5 and 6 may also be installed to the microwave oven according to the embodiment shown in FIGS. 3 and 4, and a microwave oven according to an embodiment shown in FIG. 7 as described below.

Figure 7:
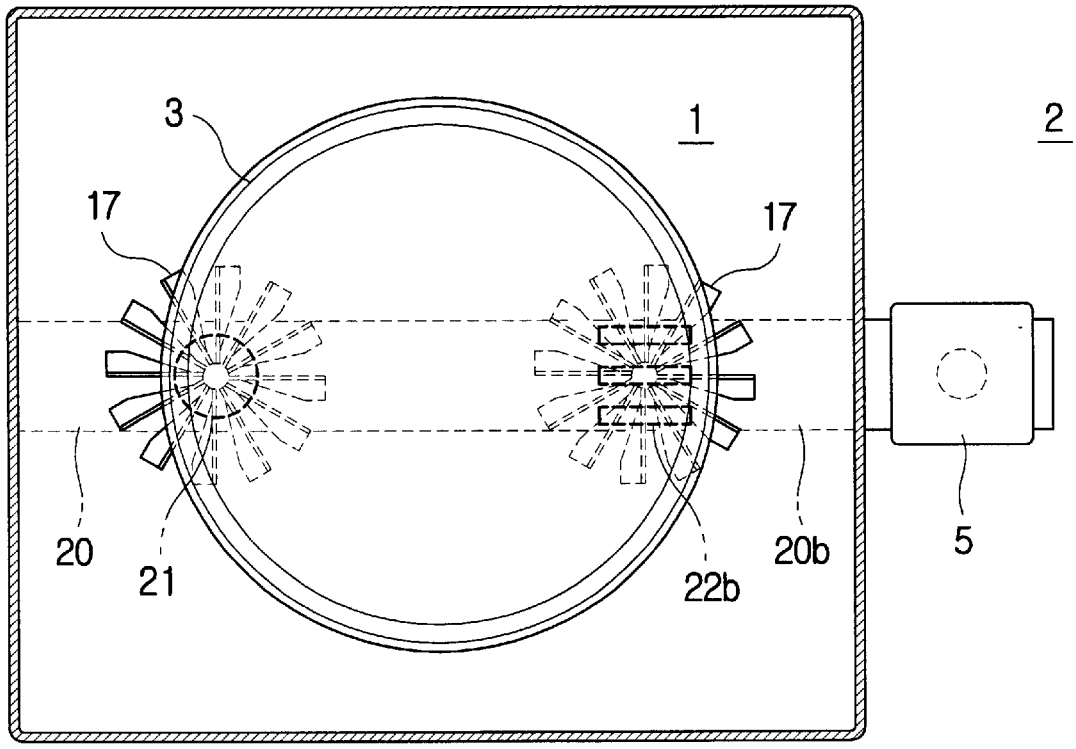
FIG. 7 is a cross-sectional view of a microwave oven having a waveguide according to yet another embodiment of the present invention.

FIG. 7 shows a microwave oven according to yet another embodiment of the present invention. The microwave oven of FIG. 7 is similar to that of FIG. 6, except that a second opening 22*b* of FIG. 7 is configured differently than the second opening 22*a* of FIG. 6.

That is, similarly to FIG. 6, the microwave oven of FIG. 7 includes a waveguide 20*b* having a first opening 21 and the second opening 22*b*, both of which are positioned at corresponding ones of locations of a waveguide 20*b*, which are away from a magnetron 5 by a distance corresponding to one of odd numbers times a half-wavelength of standing wave in the waveguide. The first opening 21 is also disposed at a downstream of the second opening 22*b*. However, the second opening 22*b* comprises one or more slits.

According to an additional aspect of the present invention, the one or more slits of the second opening 22*b* are formed on the waveguide 20*b* so as to extend in a lengthwise direction of the waveguide 20*b*. Collectively, the one or more slits are disposed away from the magnetron 5 by a distance corresponding to one of the odd numbers times the half-wavelength of the standing wave in the waveguide 20*b*, so as to allow high-frequency electromagnetic waves to easily pass through the one or more slits. However, the one of more slits of the second opening 22*b* also serve to partially interrupt a passage of the high-frequency electromagnetic waves therethrough so as to allow approximately the remaining half of the high-frequency electromagnetic waves generated from the magnetron 5 to be directed to the first opening 21 which is disposed at a downstream of the second opening 22*b*.

To avoid the repetition, the remaining components of the microwave of FIG. 7 will not be described in detail because they are the same as shown in the microwave oven according to FIGS. 3 and 4.

As described above, a microwave oven according to the present invention comprises a waveguide having an elongated box structure longitudinally arranged below a cooking cavity, and openings which are arranged in a row with a magnetron. Since the openings are parallel and not perpendicular with respect to a front face (the length) of the cooking cavity, the width of the waveguide can be significantly reduced. Accordingly, the overall size and manufacturing cost of the microwave oven can be reduced. In addition, because the openings are properly positioned in a row with the magnetron, high-frequency electromagnetic waves are uniformly dispersed throughout the internal space of the cooking cavity.

Although a few preferred embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A microwave oven comprising:

a main body including a cooking cavity and a machine room which is partitioned from the cooking cavity;

a waveguide which is disposed below the cooking cavity and the machine room; a magnetron which generates high-frequency electromagnetic waves, is housed in the machine room and coupled to the waveguide;

openings which are formed at the waveguide, and allow communication between the waveguide and the cooking cavity; and microwave dispersing apparatuses which are disposed at corresponding ones of the openings, and disperse the high-frequency electromagnetic waves, wherein the openings comprises a first opening located at the waveguide and a second opening located between the first opening and the magnetron.

2. The microwave oven as set forth in claim 1, wherein:

the waveguide comprises a laterally elongated structure, a corresponding center of the first opening is disposed at a first location away from the magnetron by a distance corresponding to one of odd numbers times a half-wavelength of a standing wave in the waveguide, and a corresponding center of the second opening is disposed at a second location which is offset from another distance away from the magnetron corresponding to another one of the odd numbers times the half-wavelength of the standing wave in the waveguide.

3. The microwave oven as set forth in claim 2, wherein the first and second openings are in alignment and in a row with the magnetron so as to reduce an overall size of the waveguide and evenly disperse the high-frequency electromagnetic waves into all sides of the cooking cavity.

4. The microwave oven as set forth in claim 2, wherein the second location of the second opening is offset from the another distance so as not to discharge all of the highfrequency electromagnetic waves through the second opening and uniformly discharge the high-frequency electromagnetic waves through the first and second openings.

5. The microwave oven as set forth in claim 1, wherein:

the waveguide comprises a laterally elongated structure, a corresponding center of the first opening is disposed at a first location away from the magnetron by a distance corresponding to one of odd numbers times a half-wavelength of a standing wave in the waveguide, and a corresponding center of the second opening is disposed at a second location away from the magnetron by another distance corresponding to another one of the odd numbers times the half-wavelength of the standing wave in the waveguide, wherein the second opening comprises a plurality of slits.

6. The microwave oven as set forth in claim 5, wherein the first and second openings are in alignment and in a row with the magnetron so as to reduce an overall size of the waveguide and evenly disperse the high-frequency electromagnetic waves into all sides of the cooking cavity.

7. The microwave oven as set forth in claim 5, wherein the plurality of slits of the second opening prevents discharge of some of the high-frequency electromagnetic waves through the second opening so as to uniformly discharge the high-frequency electromagnetic waves through the first and second openings.

8. The microwave oven as set forth in claim 1, further comprising a downward microwave dispersing apparatus which is installed at an upper portion of the cooking cavity and downwardly disperses the high-frequency electromagnetic waves reflected by the microwave dispersing apparatuses.

9. The microwave oven as set forth in claim 1, wherein the first and second openings are in alignment and in a row with the magnetron so as to reduce an overall size of the waveguide and evenly disperse the high-frequency electromagnetic waves into all sides of the cooking cavity.

10. A microwave oven having a main body including a cooking cavity and a machine room, comprising:

a waveguide including a laterally elongated structure having openings which allow communication between the waveguide and the cooking cavity, wherein the waveguide is disposed below the cooking cavity and the machine room;

a magnetron which generates high-frequency electromagnetic waves, is housed in the machine room and coupled to the waveguide; and microwave dispersing apparatuses which are disposed at corresponding ones of the openings, and disperse the high-frequency electromagnetic waves, wherein positions of the openings are in alignment and in a row with the magnetron.

11. The microwave oven as set forth in claim 10, wherein:

the openings comprise a first opening located at the waveguide and a second opening located between the first opening and the magnetron, a corresponding center of the first opening is disposed at a first location away from the magnetron by a distance corresponding to one of odd numbers times a half-wavelength of a standing wave in the waveguide, and a corresponding center of the second opening is disposed at a second location which is offset from another distance away from the magnetron corresponding to another one of the odd numbers times the half-wavelength of the standing wave in the waveguide.

12. The microwave oven as set forth in claim 11, further comprising a downward microwave dispersing apparatus which is installed at an upper portion of the cooking cavity and downwardly disperses the high-frequency electromagnetic waves reflected by the microwave dispersing apparatuses.

13. The microwave oven as set forth in claim 10, wherein:

the openings comprise a first opening located at the waveguide and a second opening located between the first opening and the magnetron, a corresponding center of the first opening is disposed at a first location away from the magnetron by a distance corresponding to one of odd numbers times a half-wavelength of a standing wave in the waveguide, and a corresponding center of the second opening is disposed at a second location away from the magnetron by another distance corresponding to another one of the odd numbers of times the half-wavelength of the standing wave in the waveguide, wherein the second opening is smaller than the first opening.

14. The microwave oven as set forth in claim 13, further comprising a downward microwave dispersing apparatus which is installed at an upper portion of the cooking cavity and downwardly disperses the high-frequency electromagnetic waves reflected by the microwave dispersing apparatuses.

15. The microwave oven as set forth in claim 10, wherein:

the openings comprise a first opening located at the waveguide and a second opening located between the first opening and the magnetron, a corresponding center of the first opening is disposed at a first location away from the magnetron by a distance corresponding to one of odd numbers times a half-wavelength of a standing wave in the waveguide, and a corresponding center of the second opening is disposed at a second location away from the magnetron by another distance corresponding to another one of the odd numbers times the half-wavelength of the standing wave in the waveguide, wherein the second opening comprises a plurality of slits.

16. The microwave oven as set forth in claim 15, further comprising a downward microwave dispersing apparatus which is installed at an upper portion of the cooking cavity and downwardly disperses the high-frequency electromagnetic waves reflected by the microwave dispersing apparatuses.

17. The microwave oven as set forth in claim 15, wherein the plurality of slits extend in a direction along the laterally elongated structure of the waveguide.

18. A microwave oven having a main body including a cooking cavity and a machine room, comprising:

a waveguide including a laterally elongated structure having openings which allow communication between the waveguide and the cooking cavity, wherein the waveguide is disposed below the cooking cavity and the machine room;

a magnetron which generates high-frequency electromagnetic waves, is housed in the machine room and coupled to the waveguide; and microwave dispersing apparatuses which are disposed at corresponding ones of the openings, and disperse the high-frequency electromagnetic waves, wherein the openings are in a row which is parallel to a length of a front face of the cooking cavity.

19. The microwave oven as set forth in claim 18, wherein:

the openings comprise a first opening located at the waveguide and a second opening located between the first opening and the magnetron, a corresponding center of the first opening is disposed at a first location away from the magnetron by a distance corresponding to one of odd numbers times a half-wavelength of a standing wave in the waveguide, and a corresponding center of the second opening is disposed at a second location which is offset from another distance away from the magnetron corresponding to another one of the odd numbers times the half-wavelength of the standing wave in the waveguide.

20. The microwave oven as set forth in claim 19, further comprising a downward microwave dispersing apparatus which is installed at an upper portion of the cooking cavity and downwardly disperses the high-frequency electromagnetic waves reflected by the microwave dispersing apparatuses.

21. The microwave oven as set forth in claim 18, wherein:

the openings comprise a first opening located at the waveguide and a second opening located between the first opening and the magnetron, a corresponding center of the first opening is disposed at a first location away from the magnetron by a distance corresponding to one of odd numbers times a half-wavelength of a standing wave in the waveguide, and a corresponding center of the second opening is disposed at a second location away from the magnetron by another distance corresponding to another one of the odd numbers times the half-wavelength of the standing wave in the waveguide, wherein the second opening comprises a plurality of slits.

22. The microwave oven as set forth in claim 21, further comprising a downward microwave dispersing apparatus which is installed at an upper portion of the cooking cavity and downwardly disperses the high-frequency electromagnetic waves reflected by the microwave dispersing apparatuses.

23. The microwave oven as set forth in claim 21, wherein the plurality of slits extend in a direction along the laterally elongated structure of the waveguide.

* * * * *